United States Patent [19]

Tanaka et al.

[11] Patent Number: 4,485,760

[45] Date of Patent: Dec. 4, 1984

[54] DRY PROCESS DEVELOPING METHOD AND DEVICE EMPLOYED THEREFOR

[75] Inventors: Susumu Tanaka; Tateki Oka, both of Sakai, Japan

[73] Assignee: Minolta Camera Kabushiki Kaisha, Japan

[21] Appl. No.: 341,146

[22] Filed: Jan. 20, 1982

Related U.S. Application Data

[62] Division of Ser. No. 863,616, Dec. 23, 1977, Pat. No. 4,331,757.

[30] Foreign Application Priority Data

Dec. 29, 1976 [JP] Japan ..... 51-158110

[51] Int. Cl.³ ..... G03G 15/08

[52] U.S. Cl. ..... 118/657; 118/658; 355/3 DD

[58] Field of Search ..... 118/657, 658; 355/3 DD

[56] References Cited

U.S. PATENT DOCUMENTS

| | | | |
|---|---|---|---|
| 3,645,770 | 2/1972 | Flint | 118/677 |
| 3,941,084 | 12/1976 | Kurits | 118/657 |
| 3,941,469 | 12/1976 | Okamoto | 118/657 |
| 3,999,514 | 12/1976 | Abbott | 118/657 |
| 4,018,187 | 3/1977 | Abbot | 118/657 |
| 4,056,076 | 11/1977 | Smith | 118/658 |
| 4,142,981 | 3/1979 | Bean | 430/109 |

*Primary Examiner*—Sam Silverberg

*Attorney, Agent, or Firm*—Wenderoth, Lind & Ponack

[57] ABSTRACT

A dry process developing method for application to electrophotography which includes the steps of mixing magnetizable toner and electrically insulating non-magnetizable toner at a predetermined ratio to form developing material, and applying said developing material onto a electrical potential pattern or electrostatic latent image formed on a recording medium for developing the latent image into visible toner image. For effecting the foregoing developing method, a developing apparatus is provided with an improved developing material supplying device for efficient developing.

3 Claims, 10 Drawing Figures (Toner mixing ratio-high)

(Toner mixing ratio-low)

DRY PROCESS DEVELOPING METHOD AND DEVICE EMPLOYED THEREFOR

This is a Rule 60 divisional of Ser. No. 863,616, now U.S. Pat. No. 4,331,757 filed Dec. 23, 1977.

BACKGROUND OF THE INVENTION

The present invention relates to electrophotography and more particularly, to a dry process developing method in electrophotography and a device employed therefor in which disadvantages inherent in the conventional dry process developing methods, for example, two component developing method employing non-magnetizable toner particles and magnetizable carrier material and one component developing method employing magnetizable toner particles are eliminated.

Generally, two component developing methods such as the cascade developing method, magnetic brush developing method, etc., are well known in the art and have been put into practical application. In such developing methods, electrically insulating non-magnetizable toner particles having average particle diameters of 10 to 15 μm and particles commonly known as carriers are mixed for use. In the cascade developing method, the non-magnetizable toner particles are charged through rubbing against the electrically insulating carrier particles of bead-like shape to be attracted onto surfaces of the carrier particles and transported to a developing position of a developing apparatus, while in the magnetic brush developing method, the carrier is formed into magnetizable particles mainly of iron of approximately 75 μm in diameter to be magnetically attracted in the form of magnetic brush bristles onto an outer cylinder or sleeve of a developing apparatus in a known manner. In the magnetic brush developing method, the non-magnetizable toner particles are charged through friction against the carrier to adhere to the surfaces of the carrier particles and transported to the developing position in the similar manner as in the cascade developing method mentioned earlier. The electrically conductive carrier particles also serve as a developing electrode positioned extremely close to a photosensitive member during developing.

The dry process two component developing method as described above, however, has various problems particularly related to the carrier in that such carrier only functions in charging and transporting the non-magnetizable toner particles or as the developing electrode (in the case of the magnetic brush developing method) without directly engaging in the developing itself. Thus is is not consumed during each copying, and gradually deteriorates with the increase in the number of copies taken, generally making it necessary to replace it after a predetermined number of copies have been taken. Although the life of the carrier seems to have been prolonged to a considerable extent due to the recent development of carriers having various coatings, replacement thereof is still required after use for a predetermined period of time. Furthermore, since the mixing ratio of the carrier to the non-magnetizable toner largely affects the quality of copied images, giving rise to adhesion of the carrier to the photosensitive member in some cases, stabilization of the mixing ratio, i.e., replenishing of the non-magnetizable toner at a constant rate is required. Although various improvements have conventionally been proposed for such stabilization of the mixing ratio to be put into practical application, the constant rate replenishment is still difficult, with the developing apparatus tending to be undesirably large in size. Particularly, when the particle size of the carrier is too small or the mixing ratio is deviated to the carrier side, the carrier may adhere onto the surface of the photosensitive member in some cases, thus adversely affecting the quality of the copied images. Moreover, since the diameter of the carrier particle can not be made excessively small due to the above fact, the increase in the surface area of such carrier particle is inevitably limited, and depending on the mixing ratio of the carrier to the non-magnetizable toner, there are cases where uneven charging for the non-magnetizable toner may take place.

In order to overcome the disadvantages inherent in the two component developing method as described above, there has conventionally been proposed one component developing method employing magnetizable toner particles, and a direct type copying apparatus, i.e., copying apparatus which uses a photosensitive paper applied with photosensitive material, without effecting transfer, and which is based on the one component developing method has already been put into practical use. Meanwhile, although various attempts have also been made to apply the one component developing method to the copying apparatuses of transfer type, there are difficult problems to be solved related to physical properties in the developing and transfer in that conditions contrary to each other i.e., electrical conductivity during developing and electrical insulation during transfer are simultaneously required. More specifically, while the developing is successful in the case of the electrically conductive, magnetizable toner particles having high electrical conductivity, there is a disadvantage such that during electric field transfer onto plain copy paper, the polarity of the magnetizable toner is varied due to injection of charges thereto from the copy paper, thus resulting in the so-called phenomenon of Blow-off in which the toner once transferred onto the copy paper again leaves the same copy paper to cause non-uniform density and fogging in the copied images.

For eliminating the undesirable non-uniform density and fogging in the copied images as described above, there have conventionally been proposed various arrangements such as employment of electrically insulated copy paper (disclosed, for example, in Japanese Patent Publications Nos. Tokkaisho 50/90336, and Tokkosho 49/11576), pre-heating of copy paper (disclosed, for example, in Japanese Patent Publication No. Tokkaisho 50/43936), and uniform exposure of photosensitive surface to light before or during transfer (disclosed, for example, in Japanese Patent Publications Nos. Tokkaisho 51/26044 and Tokkaisho 51/96332), etc., none of which is, however, related to improvement of the one component developing method.

On the contrary, the electrically insulating magnetizable toner particles have problems related to developing. More specifically, since such electrically insulating magnetizable toner particles are not sufficiently stable in charging, the developed images tend to be undesirably soiled, and for eliminating such disadvantages, auxiliary means, for example, means for subjecting the electrically insulating magnetizable toner to corona charging within the developing apparatus is required as disclosed in Japanese Patent Publication No. Tokkaisho 50/117432, thus resulting in complication in the structure of the developing apparatus.

Although a developing method employing magnetizable toner having properties intermediate the electrically conductive magnetizable toner and the electrically insulating magnetizable toner has also been conventionally proposed, for example, in Japanese Patent Publication Tokkaisho 50/92137, it is quite doubtful whether such magnetizable toner can satisfactorily provide the properties of the electrically conductive magnetizable toner and electrically insulating magnetizable toner, while problems arise in such magnetizable toner from the viewpoints of difficulty in manufacturing thereof, stability under various temperatures and humidity conditions, etc.

Another disadvantage inherent in all one component magnetizable toner particles is that due to the necessity for employing magnetizable material, the cost of the toner tends to be high, and that since it is hard to increase the ratio of resin in such magnetizable toner particles, there is a difficulty in fixing thereof.

In order to eliminate disadvantages as described in the foregoing, the present inventors have completed novel developing method explained in detail later in the present application in which non-magnetizable toner particles and magnetizable toner particles are mixed to form developing material, while the magnetizable toner particles are adapted to function as a conventional carrier so as to be consumed in a similar manner to the non-magnetizable toner particles when attracted onto an electrostatic latent image formed on a recording medium or photosensitive member during developing.

In the novel method as described above, since the carrier (referred to as the magnetizable toner particles) is consumed, deterioration and the necessity for replacement of the carrier have been eliminated, but on the contrary, it has become necessary to replenish such carrier. For replenishing the toner and carrier, a developing material, a replenishing device having a replenishing vessel or tank in which the toner of nonmagnetizable particles and the carrier of magnetizable particles pre-mixed at predetermined rate are contained for suitable replenishment may be conceived.

Additionally, there has further been proposed another known magnetic brush developing method, for example, in Japanese Patent Publication No. Tokkaisho 52/65443 wherein developing material composed of low resistant toner and high resistant toner, at least one of which is magnetizable toner, is employed for subjecting both of the toners to frictional charging, with electrostatic attraction therebetween being adapted to be larger than magnetic attraction of a magnet disposed in a sleeve so as to cause both of said toners to adhere to the electrostatic latent image for effecting the development. In the conventional method as described above in which the high resistant ordinary toner moves onto the photosensitive member, while attracting the low resistant magnetizable toner, it is only the high resistant ordinary toner that plays the main part in the developing. Accordingly, there is a possibility that the quality of copied images is varied depending on the amount of the high resistant ordinary toner in the developing material; thus adverse effects therefrom are to be expected if such rate is altered for some reason. Moreover, since the developing is mainly dependent on the electrostatic attraction due to charge on the photosensitive member only exerting force on the high resistant ordinary toner, it is not considered to be possible to alter the amount of the high resistant ordinary toner, to a large extent, in order to obtain a predetermined level of the image quality.

Accordingly, an essential object of the present invention is to provide an improved dry process developing method for electrophotography in which mixture of electrically insulating non-magnetizable toner particles used for the conventional two component developing method and magnetizable toner particles used for the conventional one component developing method is employed as a developing material for eliminating disadvantages inherent in the known dry process two component developing methods and one component developing methods.

Another important object of the present invention is to provide an improved dry process developing method as described above which is applicable to electrophotographic copying apparatuses of various types for development in an efficient manner.

A further object of the present invention is to provide a developing apparatus equipped with a developing material supplying device for effecting the improved dry process developing method as described above under optimum conditions.

A still further object of the present invention is to provide a developing apparatus of the above described type which is simple in construction and stable in functioning, and can be readily incorporated into electrophotographic copying apparatuses of various types at low cost.

SUMMARY OF THE INVENTION

In accomplishing these and other objects, according to the present invention, the dry process developing method includes the steps of mixing magnetizable toner and electrically insulating non-magnetizable toner having predetermined properties at a predetermined mixing ratio in weight to form developing material, and supplying the developing material onto electrical potential pattern or electrostatic latent image formed on a recording medium for developing the electrical potential pattern and into a visible toner image. For effecting the developing method as described above in an efficient manner, the developing apparatus is equipped with an improved developing material supplying device including a container in which the developing material is accommodated to be supplied onto the electrical potential pattern on the recording medium in a manner described in detail later, with substantial elimination of disadvantages inherent in the conventional one component and two component developing methods.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
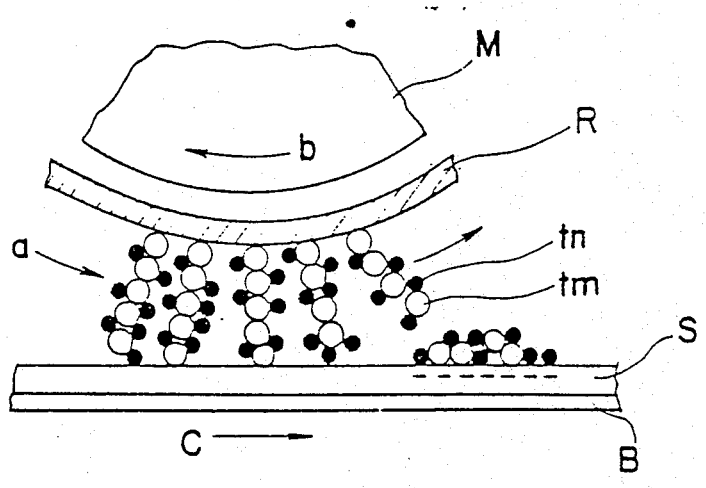
FIG. 1 is a fragmentary schematic diagram explanatory of developing phenomenon according to the dry process developing method of the present invention.

In the dry process developing method according to the present invention, there is employed a mixture of electrically insulating non-magnetizable toner particles used for the conventional two component developing method and magnetizable toner particles used for the conventional one component developing method as developing material. The electrically insulating non-magnetizable toner particles should have particle diameters of 3 to 30 μm and more preferably 5 to 20 μm. If the particle diameter becomes too large, roughness in copied images is brought into question, and therefore, such particle size should be 30 μm at the maximum, and up to 20 μm where possible. On the contrary, if the particle size is too small, fogging in copied images and the so-called "spent toner" (toner formed by the non-magnetizable toner integrally adhering to the magnetizable toner) tend to take place. Therefore, particle diameter larger than 3 μm and more preferably larger than 5 μm is generally required. On the other hand, the magnetizable toner particles should have resistivity of $10^5$ to $10^{14}$ Ω·cm and more preferably 10 to $10^{14}$ Ω·cm, and particle diameters of 3 to 30 μm and more preferably 10 to 20 μm. If the particle diameter exceeds 30 μm, roughness in the copied images may result in the similar manner as in the non-magnetizable toner particles, while there is a possibility that faulty transfer takes place due to insufficient contact of the toner around the magnetizable toner particles with copy paper. If possible, the particle diameter should be up to 20 μm. Meanwhile, if the particle diameter is less than 3 μm, there is a problem in slidability thereof on an outer sleeve of a developing apparatus, and even the magnetizable toner particles alone do not have sufficient movability on the outer sleeve, which trend is further aggravated if the non-magnetizable toner particles are mixed therewith. On the other hand, if the magnetizable toner particles have particle diameters less than 10 μm, there is a problem in allowing such particles to move on the outer sleeve for a long period of time. In other words, such toner particles tend to be hardened in the developing position and doctor blade or restricting plate due to excessive slipping thereof on the outer sleeve, thus resulting in unevenness in the copied images.

In the preparation of the mixture as described above, it is necessary that the magnetizable toner particles and non-magnetizable toner particles have approximately the same particle diameter, and that the non-magnetizable toner particles are located above (or below) the magnetizable toner particles or more preferably separated from the latter in the frictional charging row. The mixing ratio in weight of the non-magnetizable toner particles to the magnetizable toner particles may be in the range from approximately 1% up to 250%, the best mixing ratio, of course, varying with the nature of both types of toner particles.

In the mixing of the non-magnetizable toner particles and magnetizable toner particles, they may be preliminarily mixed for storing in the developing apparatus or may be mixed within the developing apparatus in the similar manner as in the carrier and non-magnetizable toner particles in the conventional two component magnetic brush developing method.

The non-magnetizable toner particles are subjected to frictional charging (positive or negative) upon contact with the magnetizable toner particles within the developing apparatus, and adhere to the magnetizable toner particles to be transported up to a developing position. It is to be noted here that in the above process, the magnetizable toner particles play the part of the carrier in the conventional two component developing method, also serving as a developing electrode during the developing, with substantial elimination of disadvantages inherent in the conventional developing methods employing the carrier. More specifically, in the developing method according to the present invention, since the magnetizable toner particles exclusively used for the developing are consumed through adhesion thereof onto the photosensitive member, with fresh magnetizable toner particles being successively replenished, the deterioration of the carrier inherent in the conventional developing method has been eliminated without necessity for replacement of such carrier, while the undesirable non-uniform density and fogging in copied images due to adhesion of carrier mentioned earlier has been completely obviated. Additionally, with respect to the stabilization of mixing ratio of the carrier to the non-magnetizable toner particles, i.e., constant amount replenishing of the non-magnetizable toner particles, which has been one of the major problems in the conventional two component developing method, a slight deviation in the mixing ratio of the magnetizable toner particles to non-magnetizable toner particles in the dry process developing method of the present invention does not adversely affect the quality of the copied images through offsetting action between the two kinds of toner particles, since both of the toner particles are directly used for developing. More specifically, when the mixing ratio of the magnetizable toner particles to non-magnetizable toner particles is varied in the developing material, the amount of such magnetizable toner particles and non-magnetizable toner particles adhering to the photosensitive member during developing is also varied, and thus there is almost no variation in the total amount of toner to adhere to the photosensitive member. Therefore, the quality of the copied images is not affected by the variation of the mixing ratio of the two kinds of toner particles in the developing material.

As is seen from the foregoing description, according to the present invention, the constant amount replenishing device of developing material for maintaining a constant mixing ratio in the conventional two component developing method can be further simplified in construction, with compact size of the developing apparatus and consequently of the copying apparatus. Furthermore, in the carrier-like function of the magnetizable toner particles, since the undesirable adhesion of the carrier need not be taken into account as described earlier, the particle diameter of the toner particles may be reduced to provide a large surface area of the whole, thus uniform charging of the non-magnetizable toner particles being made possible. More specifically, when there exists a predetermined amount of carrier particles in weight ratio in the developing material, the total surface area of the carrier particles can be increased by making the diameters of the carrier particles small. Since the toner particles are subjected to frictional charging at the surfaces thereof, the larger the surface area of the toner particles, the more uniformly they are to be charged.

Figure 2:
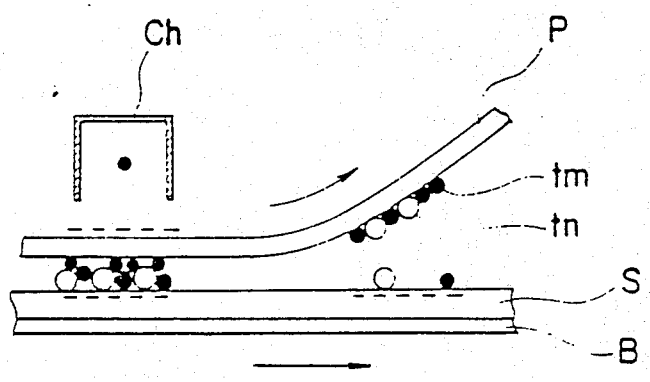
FIG. 2 is a fragmentary schematic diagram explanatory of transfer phenomenon according to the dry process developing method of the present invention.

Referring now to the drawings, developing and transferring phenomena in the dry proces developing method according to the present invention will be described with reference to FIGS. 1 and 2 respectively. In FIG. 1 which depicts a stage in the developing process, a photoconductive photosensitive member S formed on a conductive backing B is negatively charged, while the non-magnetizable toner particles $t_n$ shown by black circles are positively charged. In a similar manner as in the conventional two component developing method, the non-magnetizable toner particles $t_n$ are carried, up to the developing position whereat they contact the surface of the photosensitive member S, along the surface of a known metallic outer sleeve R in a direction or arrow a in which a magnetic roller M is rotatably housed for rotation in the direction of arrow b, with magnetizable toner particles $t_m$ shown by white circles acting as the carrier and good developing electrode, and subsequently move onto the surface of the photosensitive member S moving in a direction of the arrow c according to levels of potential on said surface. Meanwhile, the magnetizable toner particles $t_m$ also move onto the surface of the photosensitive member S according to the levels of potential on said surface through the known developing phenomena of the one component magnetizable toner particles disclosed, for example, in U.S. Pat. No. 3,909,258 in which charge corresponding to an electrostatic latent image on the photosensitive member is induced in the toner particles located at the extreme distal ends of magnetic brush formed by magnetizable toner particles for enabling said toner particles to move onto the photosensitive member through electrostatic attraction. On the other hand, FIG. 2 depicts a stage in the transferring operation wherein the non-magnetizable toner particles $t_n$ are known to be transferred onto a copy paper sheet P charged, for example, by a corona charger ch disposed adjacent to the reverse surface of said copy paper sheet p, and it is considered that the magnetizable toner particles $t_m$ brought into contact with such non-magnetizable toner particles $t_n$ also adhere to the non-magnetizable toner particles $t_n$ by electrical mirror image force, i.e., attracting force exerted by electrical charge of opposite sign induced in the magnetizable toner particles $t_m$ against electrical charge on the non-magnetizable toner particles $t_n$ approaching the surface of said magnetizable toner particles $t_m$, and the van der Waal's forces, i.e., weak attraction exerted between molecules, while injection of charge into such magnetizable toner particles $t_m$ (through the copy paper sheet P by the corona charger ch) is almost prevented by the non-magnetic toner particles $t_n$ for enabling the magnetizable toner particles $t_m$ to be satisfactorily transferred together with the non-magnetizable toner particles $t_n$.

Accordingly, in the dry process developing method according to the present invention, the various problems related to the conventional one component developing method mentioned earlier need not be taken into account, while it is unnecessary to employ the insulated copy paper or to pre-heat the copy paper as proposed for eliminating the non-uniform density and fogging of copied images in the conventional one composition developing methods, and thus a compact developing apparatus and consequent compact copying apparatus having long life can be provided.

Figure 3:
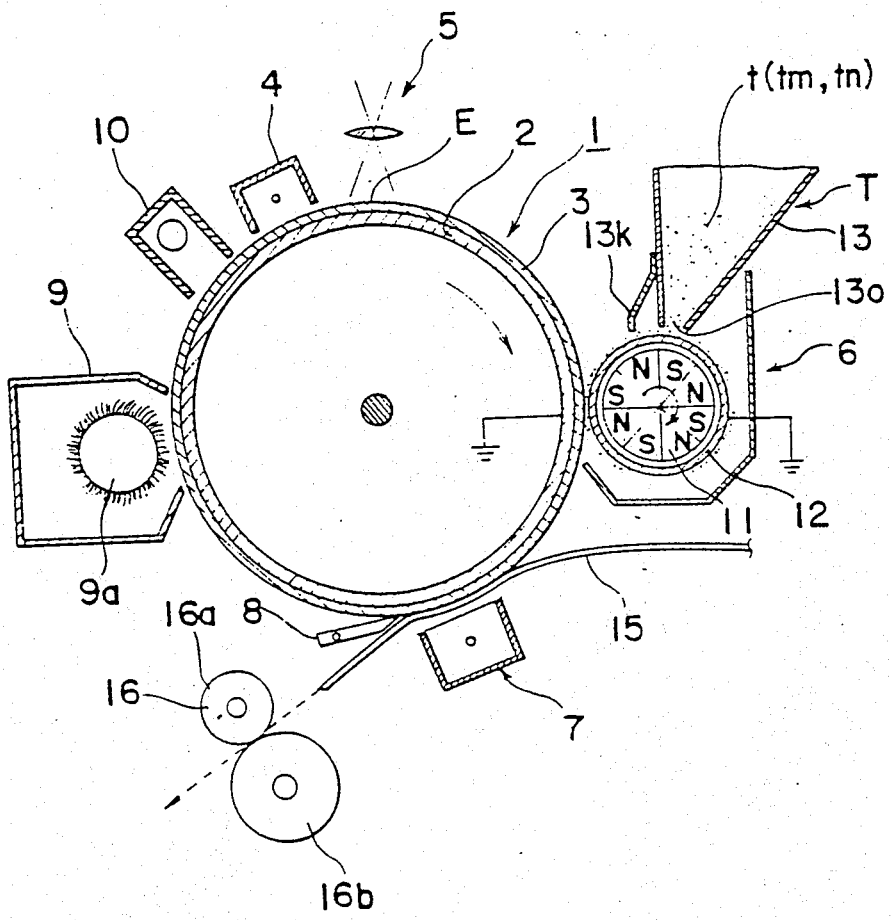
FIG. 3 is a schematic side sectional view of a transfer type electrophotographic copying apparatus in which a developing device of magnetic brush type is provided with a dry process developing material supplying device for effecting the developing method according to the present invention.

Referring now to FIG. 3, there is shown a transfer type electrophotographic copying apparatus equipped with a developing apparatus to which the dry process developing method of the present invention is applicable. In FIG. 3, the electrophotographic copying apparatus generally includes a photosensitive or photoreceptor drum 1 composed of a photoconductive photosensitive layer 3 formed on an electrically conductive base 2 which defines the peripheral surface of the drum 1 and rotatably disposed for rotation in the direction of the arrow, while various processing stations such as a corona charger 4, an exposure station E associated with an optical exposure system 5 for exposing the photosensitive layer 3 to image-wise light from an original (not shown), a magnetic brush developing apparatus 6, a transfer device 7, a copy paper separating means 8, a cleaning device 9, an eraser lamp 10, etc., are sequentially disposed around the photosensitive drum 1 in a known manner. During rotation of the photoreceptor drum 1, the surface of the photoconductive layer 3 thereof is first uniformly charged by the corona charger 4 so as to be subsequently exposed to the image-wise light through the exposure system 5, and the charge on the portion of the surface of the photoconductive layer 3 subjected to the image-wise light is led away to the photoconductive base 2, with the electrostatic latent image corresponding to the original being formed on the photoconductive layer 3. The electrostatic latent image thus formed is developed into a visible image upon electrostatic adhesion thereto of developing material supplied by the magnetic brush developing apparatus 6. The magnetic brush developing device 6 further includes an electrically conductive stationary outer cylinder or sleeve 12 of non-magnetizable material in which a magnet roller 11 having a plurality of magnetic poles is rotatably housed for rotation in the direction of the arrow, and a developing material supplying device T having a container or supplying tank 13 disposed above the outer sleeve 12 and accommodating therein the developing material t to be used in the present invention, i.e., a mixture of magnetizable toner particles $t_m$ and electrically insulating non-magnetizable toner particles $t_n$. The mixture of the both toner particles supplied onto the outer sleeve 12 through an opening 13*o* formed at the lower portion of the tank 13 is formed into magnetic brush bristles on the outer sleeve 12. It is to be noted here that the above magnetic brush bristles are formed in such a manner that the magnetizable toner particles $t_m$ are attracted onto the outer sleeve 12 in the form of the magnetic brush through magnetic attraction by the magnet roller 11, with the non-magnetizable toner particles $t_n$ being electrostatically attracted onto the magnetizable toner particles $t_m$ through triboelectrical charging therebetween, i.e., in a similar manner as in the so-called two component developing material. The magnetic brush bristles thus formed move on the outer sleeve 12 in the direction opposite to the direction of rotation of the magnet roller 11 as said magnet roller 11 rotates, with the height or thickness of such magnetic brush being restricted by a doctor blade 13*k* fixed to one side wall of the tank 13 immediately above the outer sleeve 12, and are brought into contact with the electrostatic latent image formed on the photoconductive layer 3. In this case, according to the magnitude of the surface potentials on the photoconductive layer 3 resulting from the formation of the electrostatic latent image thereon, the non-magnetizable toner particles $t_n$ move onto the photoconductive layer 3 through the magnetic brush developing phenomenon as in the conventional two component developing material, while the magnetizable toner particles $t_m$ also move onto said photoconductive layer 3 through the developing phenomenon in the conventional one component magnetizable toner particles for developing the latent image into the visible toner image. Subsequently, the toner image thus developed by both of the toner particles is brought into close contact with plain copy paper 15 fed through a copy paper feeding device (not shown) and is subjected by the transfer device 7 (corona charger) to corona charging of opposite polarity to the polarity of charge of the non-magnetizable toner particles $t_n$ and the magnetizable toner particles $t_m$ contacting the non-magnetizable toner particles $t_n$ are caused to adhere onto the copy paper 15 together with the non-magnetizable toner particles $t_n$ through the electrical mirror image force and van der Waal's force mentioned earlier.

The copy paper 15 onto which the toner image has been transferred in the above described manner is separated from the photosensitive surface 3 of the photoreceptor drum 1 by the copy paper separating means or separating claw 8 pivotally disposed subsequent to the transfer device 7 to be further fed into the fixing device 16 including juxtaposed heat rollers 16*a* and 16*b* whereat the toner image is fixed onto the copy paper 15. On the other hand, the toner particles remaining on the photosensitive layer 3 after the transfer are removed by the cleaning device 9 including a rotary brush 9*a*, while residual potential on the photosensitive layer 3 is erased through total surface projection of light onto the layer 3 by the eraser lamp 10, and thus the whole copying process is completed, with the photoreceptor drum 1 being ready for the subsequent copying operation.

Figure 4:
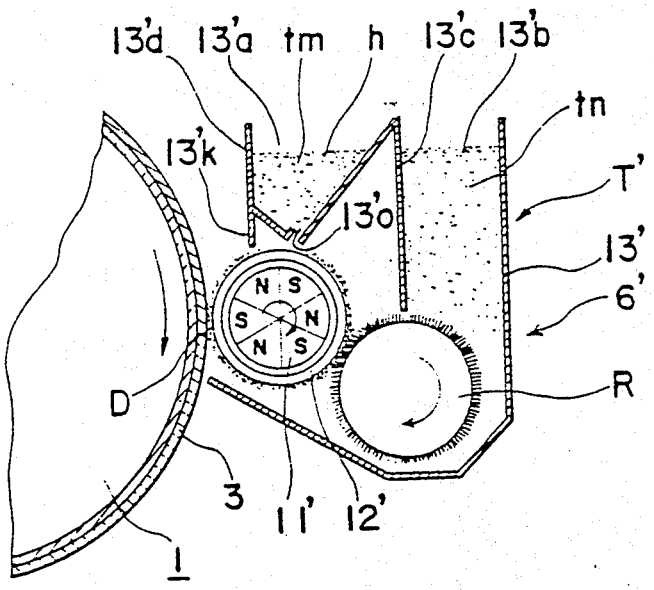
FIG. 4 is a similar view to FIG. 3 partly broken away, but particularly shows a modification of the arrangement of FIG. 3.

Referring now to FIG. 4, there is shown a modification of the developing apparatus of FIG. 3. The developing apparatus 6' of FIG. 4 is equipped with a modified developing material supplying device T' for supplying the developing material i.e., non-magnetizable toner particles $t_n$ and magnetizable toner particles $t_m$ from separate containers through proper control means. In the supplying device T', the supplying tank 13 together with the doctor blade 13*k* described as employed in the arrangement of FIG. 13 is replaced by a modified supplying tank 13' divided by a partition wall 13'*c* into two compartments 13'*a* for accommodating therein the magnetizable toner particles $t_m$ and 13'*b* for accommodating therein the non-magnetizable toner particles $t_n$. In a space defined by an open bottom portion of the container 13'*b* and a bottom wall of the supplying tank 13', a roller R having brush bristles filled on its outer periphery is rotatably provided for rotation in the direction of the arrow, while the container 13'*a* has walls extending slantwise toward the outer sleeve 12 from the partition wall 13'*c* and a corresponding side wall 13'*d* of the tank 13' to define a supplying opening 13'*o* immediately above the outer sleeve 12' and forming a hopper portion h for the magnetizable toner particles tm, while the lower end of the side wall 13'*d* of the tank 13' forming a doctor blade 13'*k*. Upon rotation of the brush roller R provided at the lower open portion of the container 13'*b*, the non-magnetizable toner particles $t_n$ fed from the container 13'*b* and caught in the brush bristles of the roller R are supplied to the vicinity of the outer sleeve 12' and adhere to the magnetizable toner particles $t_m$ supplied from the hopper portion h and adhering onto the sleeve 12' through magnetic attraction. As the magnet roller 11' (, for example, of six poles) rotates, the developing material or the outer sleeve 12' moves counterclockwise in FIG. 4, and subsequently, the magnetizable toner particles $t_m$ are supplied from the hopper portion h through the opening 13'*o* to form the magnetic brush on the outer sleeve 12'. The magnetic brush thus formed is transported to a developing position D with respect to the photoreceptor drum 1, with thickness of the magnetic brush being restricted by the doctor blade 13'*k*, and is brought into contact with the electrostatic latent image formed on the photosensitive layer 3 of the photoreceptor drum 1 which is rotated in the direction of the arrow to develop such latent image into the visible image. In the arrangement as described above, since the magnetizable toner $t_m$ serving for frictionally charging and transporting the non-magnetizable toner $t_n$ is consumed through the one component magnetizable toner developing method mentioned earlier, with its consumption being limited only to tip portions of the magnetic brush, the non-magnetizable toner $t_n$ is supplied by a predetermined amount by the brush roller R as said roller R rotates, while the magnetizable toner $t_m$ is replenished from the container13'*a* by the amount consumed at the developing. Therefore, the non-magnetizable toner $t_n$ and the magnetizable toner $t_m$ are individually supplied, depending on respective consumption thereof, and it is possible to bring the mixing ratio of the developing material to a proper value by suitably controlling the rotation of the brush roller R. Moreover, by effecting control in such a manner that when the consumption of the non-magnetizable toner tn is large, the rotational speed of the brush roller R is increased, while on the other hand, if the consumption of the same magnetizable toner $t_n$ is small, the rotational speed of the brush roller R is decreased and the mixing ratio of the developing material to be transported to the developing position can be held at an approximately constant level.

Figure 5:
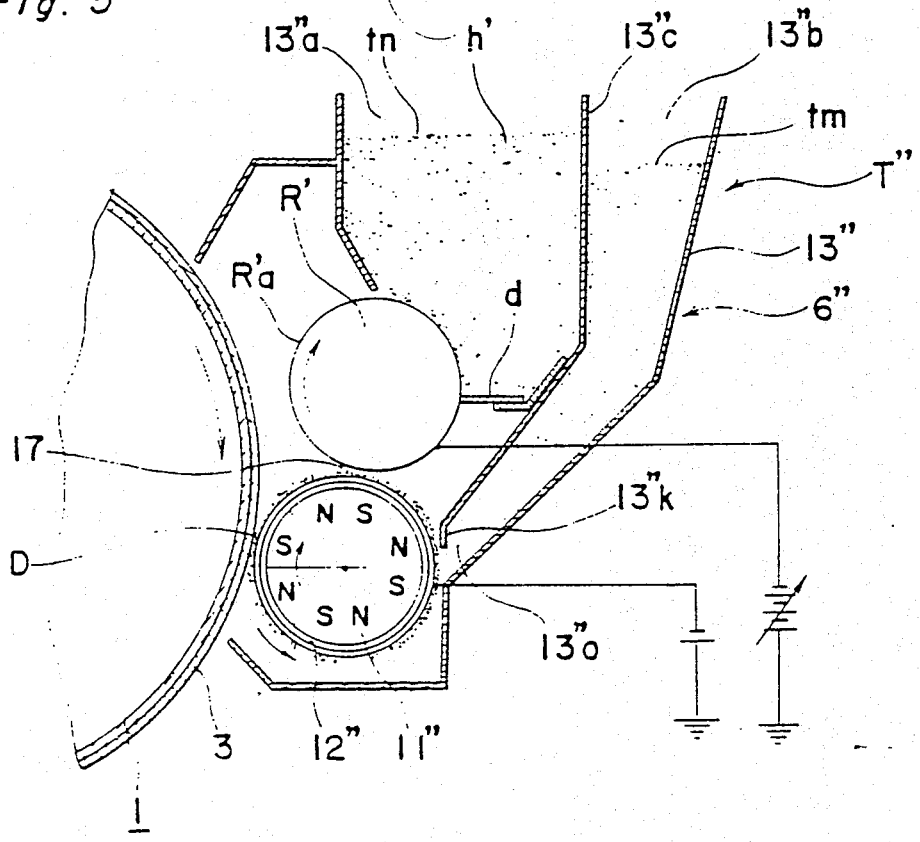
FIG. 5 is a similar view to FIG. 4, but particularly shows a further modification of the arrangement of FIG. 3, FIG. 6(*a*) is a fragmentary top plan view showing, on an enlarged scale, the state of undulation or convex and concave portions formed on a peripheral surface of a roller member employed in the arrangement of FIG. 5, FIG. 6(*b*) is a cross section taken along the line VI(b-)—VI(b) in FIG. 6(*a*), FIG. 7(*a*) is a similar view to FIG. 6(*b*), but particularly shows the state of toner before the roller member of FIG. 6(*a*) passes a developing region during rotation, and FIGS. 7(*b*) and 7(*c*) are similar views to FIGS. 7(*a*), but particularly show the state of toner after the roller member has passed through the developing region during rotation.

Referring also to FIG. 5, there is shown a further modification of the developing apparatus 6 of FIG. 3. The developing apparatus 6" of FIG. 5 is provided with a modified developing material supplying device T" in which the non-magnetizable toner particles $t_n$ and magnetizable toner particles $t_m$ are automatically controlled to have a constant mixing ratio irrespective of the amount thereof to be consumed. In the supplying device T", the supplying tank 13 of FIG. 3 is replaced by a supplying tank 13" divided by a partition wall 13"*c* into two compartments 13″*a* for accommodating the non-magnetizable toner particles $t_n$ and 13″*b* for accommodating the magnetizable toner particles $t_m$. Within the supplying tank 13″, at a position below the open lower portion of a hopper h′ defined by walls in the container 13″*a*, there is rotatably disposed a toner supplying roller R′ for rotation in the direction of the arrow in a position immediately above the stationary outer sleeve 12″ in which the magnet roller 11″, for example, of eight magnetic poles is rotatably housed for rotation in the direction of the arrow, while the container 13″*b* for the magnetizable toner particles $t_m$ has its lower portion 13″*o* opened adjacent to the surface of the outer sleeve 12″ and provided with a doctor blade 13″*k*. In the above arrangement, as the magnet roller 11″ rotates, the developing material on the outer sleeve 12″ is transported counterclockwise, and passes through a developing region D whereat the non-magnetizable toner particles $t_n$ and magnetizable toner particles $t_m$ of the developing material are consumed. When the developing material thus consumed further passes the open lower portion 13″*o* of the container 13″*b*, the magnetizable toner particles $t_m$ contained in the container 13″*b* are supplied through the open lower portion 13″*o* to be restricted in its amount to that equivalent to the clearance between the doctor blade 13″*k* and the outer sleeve 12″, and consequently, the developing material is replenished with the magnetizable toner particles $t_m$ by the amount as consumed. The developing material which has passed through the doctor blade 13″*k* is subsequently brought into a toner supplying region 17 whereat the toner supplying roller R′ of electrically conductive material confronts the outer sleeve 12″. The toner supplying roller R′ of electrically conductive nature is electrically connected to the above sleeve 12″ through a biasing voltage source, which is adjustable to be of the same polarity as the biasing between the outer sleeve 12″ and the charging polarity of the photosensitive layer 3.

Figure 6:
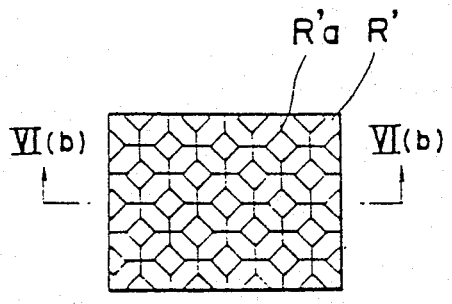
Figure 6:
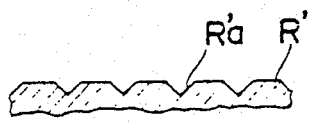
Figure 7A:
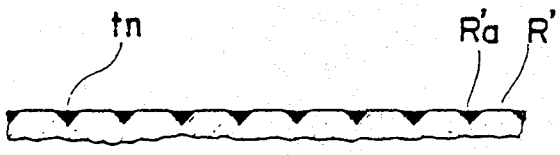
Figure 7:
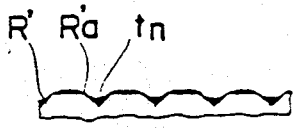
Figure 7:
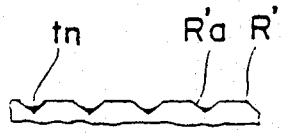

Referring also to FIGS. 6 to 7(*c*), the toner supplying roller R′ has undulation or convex and concave portions, for example, as shown in FIGS. 6(*a*) and 6(*b*) on its peripheral surface R′*a*, and the non-magnetizable toner particles $t_n$ accommodated in the hopper portion h′ of the container 13″*a* adhere onto the undulated surface R′*a* of the roller R′ as the roller R′ rotates clockwise, and since a scraping blade d further provided on one edge of the open lower portion of the hopper h′ is adapted to contact under pressure the surface R′*a* of the roller R′, the toner supplying roller R′ transports the toner to the toner supplying region 17, with the toner $t_n$ adhering only to the concave portions of the undulation on the surface R′*a* of the roller R′ as shown in FIG. 7(*a*). More specifically, in FIGS. 7(*a*) to 7(*c*), the condition of the surface R′*a* of the roller R′ before passing the toner supplying region 17 is shown in FIG. 7(*a*), while the condition thereof after passing the toner supplying region 17 is illustrated in FIGS. 7(*b*) and 7(*c*). In the state of FIG. 7(*a*), when the toner supplying roller R′ rotates up to the toner supplying region 17, the non-magnetizable toner particles $t_n$ are scraped off by the magnetic brush formed on the outer sleeve 12″, and simultaneously, since the toner supplying roller R′ is applied with the biasing voltage having the same polarity as the charging polarity for the photosensitive layer 3 with respect to the outer sleeve 12″, the non-magnetizable toner $t_n$ on the undulated surface R′*a* of the supply roller R′ is not wholly supplied, and the non-magnetizable toner particles $t_n$ thus scraped off the outer sleeve 12″ are supplied to the developing material in the form of the magnetic brush at a low rate when the toner mixing ratio is high and at a high rate when the mixing ratio is low, consequently the automatic toner supply being advantageously effected. More specifically, the non-magnetizable toner $t_n$ to be supplied in excess is collected onto the side of the supply roller R by the biasing, and consequently, the toner to be supplied is automatically adjusted to constitute a uniform developing material on the outer sleeve 12″.

With the use of the developing apparatuses according to the present invention as described in the foregoing, experiments were carried out as explained in Examples 1 to 16 given hereinbelow for illustrating the present invention, without any intention of limiting the scope thereof.

In Examples 1 and 2, the developing apparatus T′ of FIG. 4 is employed, while in Examples 3 to 16, the developing apparatus T of FIG. 3 is used.

It is to be noted that the following conditions for image formation are common to all of Examples described hereinbelow.

(i) The photoconductive photosensitive layer 3 was of the CdS binder type.

(ii) The photoconductive photosensitive layer 3 was charged to −750 V by the corona charger 4.

(iii) The electrostatic latent image was formed through the image exposure optical system 5 at an illumination intensity of approximately 15 lux.sec. in the bright portion.

(iv) Plain copy paper having resistivity of $10^8$ to $10^{13}$ Ω·cm was fed at the same speed of 8.7 cm/sec. as that of the photoreceptor drum.

(v) Voltage was impressed by the transfer corona charger 7 to the copy paper from the reverse surface thereof in such an intensity that when the photosensitive layer 3 is directly charged by the corona charger 7, the voltage reaches −400 V. (The intensity of the transfer corona discharge, however, has a large allowance)

EXAMPLE 1

Developing apparatus employed: Developing apparatus 6′ of FIG. 4. Magnetizable toner particles $t_m$ accommodated in the container 13′*a*: Toner having resistivity of approximately $10^{14}$ Ω·cm and average particle diameter of approximately 16 μm. Non-magnetizable toner particles $t_n$ accommodated in the container 13′*b*: Toner of a type used for conventional two component developing method, which toner having average particle diameter of approximately 12 μm and resistivity over $10^{15}$ Ω·cm is located above the magnetizable toner in the frictional charging row and charged positively through friction against the above magnetizable toner.

Revolutions of the magnet roller 11′: 1,200 r.p.m.

Revolutions of the brush roller R: 64 r.p.m.

Transfer material (copy paper): Plain copy paper (having volume resistance of approximately $10^8$ to $10^{13}$ Ω·cm)

The compositions of the magnetizable toner particles $t_m$ and non-magnetizable toner particles $t_n$ were as follows.

(i) Magnetizable toner particles $t_m$

The particle core was formed by a mixture of 100 parts by weight of styrene acryl resin and 200 parts by weight of magnetizable particles, for example, FeO.-

$Fe_2O_3$, with 4 parts by weight of coloring agent, for example, carbon black being applied onto the core.

(ii) Non-magnetizable toner particles $t_n$

The particle core was formed by 92 parts by weight of styrene resin, with 8 parts by weight of coloring agent, for example, carbon black being applied onto the core.

In the case of the above Example 1, since the resistance of the magnetizable toner particles $t_m$ is high, such magnetizable toner particles retain the charge injected at the developing even during the transferring, and it is considered that the transferring to the copy paper is favorably effected by said charge, with the influence by the injection of charge through the copy paper being prevented by the electrically insulating non-magnetizable toner particles.

In the above experiment, the mixing ratio of the magnetizable toner tm to the non-magnetizable toner $t_n$ on the outer sleeve 12' at the developing position D was approximately 1:0.4.

EXAMPLE 2

Magnetizable toner particles $t_m$ accommodated in the container 13'*a*: approximate resistivity $3.0\times10^5$ Ω-cm (To be obtained by increasing the weight percentage of the coloring agent in the composition of the magnetizable toner $t_m$ in the Example 1) with average particle diameter of 13.6 μm.

Other conditions are the same as in Example 1.

In the case of the above Example 2, since the resistance of the magnetizable toner particles $t_m$ is not very high, such magnetizable toner particles $t_m$ can not sufficiently retain the charge injected during the developing. Therefore, the transferring of the magnetizable toner $t_m$ is considered to be mainly effected by the electrical mirror image force due to the charge of the insulating non-magnetizable toner particles $t_n$. The function of the non-magnetizable toner particles $t_n$ to prevent the injection of charge into the magnetizable toner particles $t_m$ through the copy paper seems to be in a similar manner as in Example 1.

It is to be noted that in Example 2, the mixing ratio of the magnetizable toner $t_m$ to the non-magnetizable toner $t_n$ on the sleeve 12' at the developing position D was approximately 1:0.6.

It is to be noted here that there appears to be no substantial difference between Examples 1 and 2 except for the difference in the speed of the magnetizable toner particles in adhering to the photosensitive layer due to difference in resistance of such magnetizable toner particles.

As a result of the following experiment carried out employing the developing apparatus of FIGS. 5 to 7, copied images having good quality were obtained.

EXAMPLE 3

Magnetizable toner particles $t_m$ filled in the container 13''*b*: Toner having resistivity of $10^{12}$ to $10^{13}$ Ω-cm, Revolutions of the magnet roller 11'': 1,000 to 3,000 r.p.m. (outer sleeve 12'' employed had diameter of 30 mm). Revolutions of the supply roller R': 60 to 120 r.p.m. (supply roller R' employed had diameter of 30 mm). Moving speed of the photosensitive layer 3: 6 cm/sec. Biasing potential: Preferably to be set at potential higher than the residual potential on the photosensitive layer 3 by 50 to 150 V and also higher than the potential of the outer sleeve 12'' by 150 to 200 V. (in the case where the distance between the doctor blade 13''*k* and the outer sleeve 12'' is set to be 0.5 mm, with the distance between the outer sleeve 12'' and the supply roller R' set at 0.6 mm) Other conditions were the same as those in Example 1.

In the above experiment, the mixing ratio of the magnetizable toner $t_m$ to the non-magnetizable toner $t_n$ was approximately in the region from 1:0.06 to 1:0.5.

It is to be noted that in the above experiment, if the potential difference between the outer sleeve 12'' and the supply roller R' is increased higher than the above described level, inconveniences such as the so-called "break down" or adhesion of the magnetizable toner $t_m$ onto the entire surface of the supply roller R' may result, while on the other hand, if the same potential difference is lower than the above described level, the mixing ratio for the non-magnetizable toner $t_n$ on the outer sleeve 12'' tends to be too high due to insufficient recollection of the non-magnetizable toner particles.

It is also to be noted that the revolutions of the supply roller R' may be of such a degree as will permit supplying of the toner necessary to replenish the amount to be consumed for entirely black copied images, and is desirably at 60 to 120 r.p.m. in the case of the developing apparatus 6''.

Subsequently, with the use of the developing apparatus 6 of FIG. 3 in which the magnetizable toner particles $t_m$ and non-magnetizable toner particles $t_n$ preliminarily mixed at a predetermined mixing ratio is accommodated in the supplying tank 13, experiments were carried out as follows, with superior copied images being obtained in each of Examples.

EXAMPLE 4

Developing apparatus employed: Developing apparatus 6 of FIG. 3. Magnetizable toner particles $t_m$ and non-magnetizable toner particles $t_n$: The same materials as those employed in Example 1.

Mixing ratio in weight: 1 part of the magnetizable toner to 2 parts of the non-magnetizable toner.

Revolutions of the magnet roller 11: 1,300 r.p.m.

Moving speed of the photosensitive layer 3: 8.7 cm/sec

Transfer material (copy paper): Plain copy paper

COMPARATIVE DATA (1) In the case where only the one component toner is employed. With the use of the developing apparatus 6 of FIG. 3 under the similar conditions as in Example 1, magnetizable toner particles $t_m$ having resistivity of (a) $1\times10^{14}$ (Ω-cm), and (b) $3\times10^5$ (Ω-cm)

were employed for developing and transferring, with the result that in the case of the above item (a), the developing was not sufficient (insufficient density), while in the case of the above item (b), blotting or fogging due to scattering toner was noticed during the transferring.

(2) In the case where the conventional two component developing material was employed.

Although developing and transferring were acceptable, various disadvantages mentioned earlier with reference to such conventional two component developing material and known to those skilled in the art were noticed.

EXAMPLE 5

The same conditions as those in Example 4 except that the mixing ratio in weight of the magnetizable toner particles $t_m$ to non-magnetizable toner particles $t_n$ was altered to 1:1.

EXAMPLE 6

The same conditions as those in Example 4 except that the mixing ratio in weight of the magnetizable toner particles $t_m$ to non-magnetizable toner particles $t_n$ was altered to 1:0.01.

EXAMPLE 7

The same conditions as those in Example 4 except that the mixing ratio in weight of the magnetizable toner particles $t_m$ to non-magnetizable toner particles $t_n$ was altered to 1:2.5. The results were such that although favorable copied images were obtained, a slight trend to fogging and uneven density was noticed, which is due to a rather insufficient retaining force and transporting force of the magnetizable toner particles $t_m$ with respect to the non-magnetizable toner particles $t_n$.

COMPARATIVE DATA

A comparative experiment was carried out with the use of the developing apparatus 6 of FIG. 3 under the same conditions as those in Example 4 except that the mixing ratio in weight of the magnetizable toner particles $t_m$ and non-magnetizable toner particles $t_n$ was altered to 1:3. The results were such that the transporting force of the magnetizable toner particles $t_m$ with respect to the non-magnetizable toner particles $t_n$ on the outer sleeve 12 was not sufficient, only providing copied images having unevenness in density. From the above fact, it has been found that the mixing ratio in weight of the magnetizable toner particles $t_m$ and non-magnetizable toner particles $t_n$ is approximately 1:2.5 in its limit, with mixing ratio less than 1:2 giving favorable results.

COMPARATIVE DATA

Another comparative experiment was made with the use of the developing apparatus 6 of FIG. 3 under the same conditions as those in Example 4 except that the mixing ratio in weight of the magnetizable toner particles $t_m$ and non-magnetizable toner particles $t_n$ was altered to 1:0.006. As a result, the only copied images obtained were those low in density and having excessive scattering of toner, which drawbacks are considered to be attributable the high amount of the magnetizable toner particles $t_m$ in the developing material, due to which the non-magnetizable toner particles $t_n$ can not sufficiently suppress the so-called "blow off" phenomenon arising from injection of charge into the copy paper during the corona transfer onto the plain copy paper. From the above result, it has been found that the mixing ratio in weight of the magnetizable toner particles $t_m$ to non-magnetizable toner particles $t_n$ is approximately 1:0.01 at the limit. It is to be noted that in the relation of the quality of copied images with respect to the mixing ratio of the magnetizable toner particles $t_m$ to non-magnetizable toner particles $t_n$, such quality of the copied image, of course, tends to have two component-like nature, although extremely fine, with the increase of the rate of the non-magnetizable toner particles $t_n$, while the same quality becomes one component-like as the rate of the non-magnetizable toner $t_n$ decreases, but that, up to the limit of approximately 1:0.01 of the mixing rate, the undesirable blotting, toner scattering, etc. inherent in the one component developing method are suppressed to provide copied images having good quality above a certain level.

Furthermore, in order to find the range of mixing ratio in the case where magnetizable toner particles $t_m$ having high conductivity are employed, experiments were carried out using mgnetizable toner particles of $3\times10^5$ Ω·cm under the same conditions as in Example 4, with the mixing ratio in weight of the magnetizable toner particles $t_m$ to the non-magnetizable toner particles $t_n$ being altered as follows.

EXAMPLE 8

Mixing ratio in weight of the magnetizable toner particles $t_m$ to the non-magnetizable toner particles $t_n$:1:1.

The resultant copied image obtained was favorable (slight blotting).

EXAMPLE 9

Mixing ratio in weight of the magnetizable toner particles $t_m$ to the non-magnetizable toner particles $t_n$:1:2. The resultant copied image obtained was favorable (slight blotting).

EXAMPLE 10

Mixing ratio in weight of the magnetizable toner particles $t_m$ to the non-magnetizable toner particles $t_n$:1:0.1. The resultant copied image obtained was favorable (slight blotting).

EXAMPLE 11

Mixing ratio in weight of the magnetizable toner particles $t_m$ to the non-magnetizable toner particles $t_n$:1:0.01. Blotting was noticed in the transfer, with conspicuous scattering of toner.

From the above results, the mixing ratio should be up to approximately 1:0.1 at the limit for the toner having such high conductivity.

Additionally, for finding the suitable range of resistivity especially for the magnetizable toner particles $t_m$, further experiments for developing were made using the insulating non-magnetizable toner having resistivity over $10^{15}$ Ω·cm (measuring limit) which was mixed, at the mixing ratio in weight of 1:0.5, with magnetizable toner having resistivities as follows, with other conditions being the same as those in Example 4.

EXAMPLE 12

Resistivity of the magnetizable toner particles $t_n$: Above $10^{15}$ Ω·cm (over measuring limit).

The results were such that the magnetizable toner particles $t_m$ did not adhere to the image forming portion. In other words, such magnetizable toner particles were not consumed for developing.

EXAMPLE 13

Resistivity of the magnetizable toner particles $t_m$: $1\times10^{14}$ Ω·cm.

Favorable results were obtained in transferring.

EXAMPLE 14

Resistivity of the magnetizable toner particles $t_m$: $1.5\times10^{10}$ Ω·cm.

Favorable results were obtained in transferring.

EXAMPLE 15

Resistivity of the magnetizable toner particles $t_m$: $1.1\times10^8$ Ω·cm.

Favorable results were obtained in transferring.

EXAMPLE 16

Resistivity of the magnetizable toner particles $t_m$: $3\times10^5$ Ω·cm.

Developing was favorable, but transferring was accompanied by slight blotting due to scattering of toner.

EXAMPLE 17

Resistivity of the magnetizable toner particles $t_n$: $4\times10^4$ Ω·cm.

Developing was favorable, but transferring was accompanied by blotting with scattering of toner.

From the above results, the range of resistivity for the magnetizable toner particles $t_m$ is $10^5$ to $10^{14}$ Ω·cm and more preferably $10^8$ to $10^{14}$ Ω·cm.

It is to be noted here that although the present invention is mainly described with reference to the developing apparatuses of FIGS. 3 to 5 and Examples 1 to 17 as given in the foregoing, the concept of the present invention is not limited in its application to such developing apparatuses and Examples alone, but may readily be modified in various ways within the scope. Particularly, the photoconductive photosensitive member 3 of CdS binder type described as negatively charged in the foregoing embodiments may be modified to be positively charged for use through proper selection of positions on the frictional charging rows of the magnetizable toner particles and non-magnetizable toner particles to be mixed. Needless to say, the present invention is applicable to direct type copying apparatuses known as Electrofax or electrostatic latent image transfer type copying apparatuses, in general, besides the toner image transfer type copying apparatuses.

It should also be noted that in the present invention, although it has been confirmed by the foregoing Examples 4 to 17 with the use of the developing apparatus of FIG. 3 that copied images of acceptable quality are obtainable if the mixing ratio of the magnetizable toner $t_m$ to the non-magnetizable toner $t_n$ on the outer sleeve 12 at the developing position D is within the range from 1:0.01 to 1:2.5, there are cases, in the developing apparatus of the pre-mixing type of FIG. 3, where variations of copied image quality may result during repeated developing for a long period of time due to constant variation of consumption rate of the magnetizable toner $t_m$ and the non-magnetizable toner $t_n$ through variations of the surface potential of the photosensitive layer 3 and of the image pattern arising from possible difference of the electrostatic charged patterns on the photosensitive layer 3 during each developing in the actual development. On the contrary, the developing apparatus of FIG. 4 is superior to that of FIG. 3 in that the brush roller R can be controlled to eliminate the problems as described above, while the developing apparatus of FIG. 5 is still more superior to that of FIG. 4 in that the control as in the apparatus of FIG. 4 can further be dispensed with through employment of the biasing system.

Although the present invention has been fully described by way of example with reference to the attached drawings, it is to be noted that various changes and modifications are apparent to those skilled in the art. Therefore, unless otherwise such changes and modifications depart from the scope of the present invention, they should be construed as included therein.

What is claimed is:

1. A dry process developing material supplying device for use in an electrophotographic developing apparatus wherein developing material including magnetizable toner and non-magnetizable toner present at a predetermined mixing ratio is consumed for developing an electrical potential pattern of predetermined polarity on a recording medium;

said dry process developing material supplying device comprising:

a housing structure and a container for accommodating therein said developing material and supplying said developing material to the electrical potential pattern by developing said electrical potential pattern into visible image;

said container comprising two compartments for respectively containing therein said magnetizable toner and said non-magnetizable toner so as to separately supply said magnetizable toner and said non-magnetizable toner via a supply port in each of said compartments, and wherein said device is of the magnetic brush developing type, having a magnet member rotatably housed in an outer sleeve and a brush roller member rotatably disposed in a position adjacent to said outer sleeve and adapted for triboelectric contact therewith, the supply port for the compartment containing non-magnetic toner being adjacent to and being adapted to directly supply said non-magnetic toner to said brush roller member; and the supply port for the compartment containing magnetic toner being adjacent to and being adapted to directly supply said magnetic toner to said outer sleeve, said brush roller member being adapted to transfer said non-magnetic toner to said outer sleeve by said triboelectric contact.

2. A dry process developing material supplying device for use in an electrophotographic developing apparatus wherein developing material including magnetizable toner and non-magnetizable toner present at a predetermined mixing ratio is consumed for developing an electrical potential pattern predetermined polarity on a recording medium, said dry process developing material supplying device comprising:

a housing structure and a container for accommodating therein said developing material and supplying said developing material to the electrical potential pattern for developing said electrical potential pattern into visible image, said container comprising two compartments for respectively containing therein said magnetizable toner and said non-magnetizable toner so as to separately supply said magnetizable toner and said non-magnetizable toner via a supply port in each of said compartments, and wherein said device is of the magnetic brush developing type, having a magnet member rotatably housed in an outer sleeve and a roller member made of an electrically conductive material and said roller member having a number of concave portions on its peripheral surface, said roller member being rotatably disposed in a position adjacent to said outer sleeve, and adapted for triboelectric contact therewith, and means for impressing a biasing voltage of predetermined value between said roller member and said sleeve, the supply port for the compartment containing non-magnetic toner being adjacent to and being adapted to directly supply said non-magnetic toner to said roller member, the supply port for the compartment containing magnetic toner being adjacent to and being adapted to directly supply said magnetic toner to said outer sleeve, said roller member being adapted to transfer said non-magnetic toner to said outer sleeve by said triboelectric contact when said biasing voltage is applied.

3. The dry process developing material supplying device of claim 2, wherein the polarity of said biasing voltage, with respect to said outer sleeve, is the same as the polarity of said recording medium.

* * * * *